US007717743B2

(12) United States Patent
Yazawa et al.

(10) Patent No.: US 7,717,743 B2
(45) Date of Patent: May 18, 2010

(54) COAXIAL CONNECTOR FIXED TO A HOUSING WITH A PIPE MEMBER

(75) Inventors: Shigehito Yazawa, Fukushima (JP); Goro Suemitsu, Tokyo (JP); Satoshi Hagiwara, Fukushima (JP)

(73) Assignees: NEC Corporation, Tokyo (JP); NEC Wireless Networks, Ltd., Fukushima (JP)

( * ) Notice: Subject to any disclaimer, the term of this patent is extended or adjusted under 35 U.S.C. 154(b) by 0 days.

(21) Appl. No.: 12/327,375

(22) Filed: Dec. 3, 2008

(65) Prior Publication Data

US 2009/0142960 A1 Jun. 4, 2009

(30) Foreign Application Priority Data

Dec. 3, 2007 (JP) ..... 2007-312435

(51) Int. Cl.
*H01R 9/05* (2006.01)

(52) U.S. Cl. ..... 439/578

(58) Field of Classification Search ..... 439/620.03, 439/578, 581, 583
See application file for complete search history.

(56) References Cited

U.S. PATENT DOCUMENTS

| | | | | |
|---|---|---|---|---|
| 4,368,940 | A * | 1/1983 | Sugiura | 439/170 |
| 5,283,853 | A * | 2/1994 | Szegda | 385/139 |
| 6,386,913 | B1 * | 5/2002 | Mohammad et al. | 439/579 |

FOREIGN PATENT DOCUMENTS

| | | | |
|---|---|---|---|
| JP | 198441980 | U | 3/1984 |
| JP | 1990135901 | A | 5/1990 |
| JP | 199269913 | A | 3/1992 |
| JP | 199448920 | Y2 | 12/1994 |
| JP | 2561038 | Y2 | 10/1997 |
| JP | 200059140 | A | 2/2000 |

* cited by examiner

*Primary Examiner*—Chandrika Prasad

(57) ABSTRACT

A coaxial connector connecting structure according to the invention includes a coaxial connector provided on an outer surface of a housing accommodating a module case of a high-frequency circuit. The module case has a thick side wall with a first through-hole to provide a coaxial space forming portion as a pipe structure so as to be separated from the housing.

10 Claims, 8 Drawing Sheets

COAXIAL CONNECTOR FIXED TO A HOUSING WITH A PIPE MEMBER

INCORPORATION BY REFERENCE

This application is based upon and claims the benefit of priority from Japanese Patent Application No. 2007-312435, filed on Dec. 3, 2007, the disclosure of which is incorporated herein in its entirety by reference.

BACKGROUND OF THE INVENTION

1. Technical Field

The present invention relates to a coaxial connector connecting structure connecting a coaxial connector provided on a housing of a high-frequency circuit and a high-frequency circuit module case accommodated in the housing, and a high frequency device equipped with the coaxial connector connecting structure.

2. Background Art

A high-frequency device such as wireless transmitter and receiver, a radio transmitter, a radio receiver and a linear amplifier is provided with a coaxial structural section of a high-frequency circuit which treats a high-frequency signal such as microwave. Such a coaxial structural section may have to perform plating treatment to an inner wall around a central conductor in order to secure a high signal characteristic by reducing loss due to a skin effect.

However, owing to the nature of the plating treatment, unnecessary plating is inevitable for the entire region composing the space of the coaxial structural member and thereby increasing the cost of the plating treatment. When a high frequency circuit is used in outdoor equipment, waterproof treatment is needed so that water does not enter its interior so as not to generate corrosion caused by water such as rainwater adhered to an electric potential difference part between the plating material and the other metal contacted thereto.

In order to solve the above-mentioned problem, the plating treatment area should be made minimal while the structure excellent in signal characteristic should be realized.

Technological examples related to connecting structure of a high-frequency circuit are disclosed in following patent documents 1-6.

The patent document 1 (Japanese Utility Model Registered No. 2561038) discloses a high-frequency signal connecting unit where a coaxial connector provided on a box-shaped metal case is designed to have a tapered outer surface of a sleeve structure. One end of this sleeve is arranged to pass through a side of the metal case and fixed to the metal case by using a nut located in the case. The other side of this sleeve is fitted in between an insulator and an outer conductor of a coaxial cable. Accordingly, a central conductor of the coaxial cable is arranged such that, at the outside of the metal case, it is completely covered with the sleeve which entirely touched with the outer conductor, and in the inside of the metal case, the central conductor is completely covered with the metal case.

In the patent document 2 (Japanese Utility Model Application Laid-Open No. SHO-59(1984)-041980), a connecting structure between two high-frequency circuit chassis is disclosed where a connecting tool of a thick cylindrical conductor is inserted in a connecting location between opposing side walls of two chassis and being fixed to the chassis by using nuts, respectively. Each wall attached with the connecting tool is provided with a hole having a diameter which is equal to the inside diameter of the connecting tool internal space or rather somewhat larger than that, and an insulated wire is fitted through the internal space of the connecting tool such that the insulated wire has a central conductor of a diameter by which the characteristic impedance would be $Z_0$.

The patent document 3 (Japanese Utility Model Application Laid-Open No. HEI-06(1998)-048920) discloses a fixing structure for electronic parts or the like in which the electronic part or the like is inserted into an attachment hole provided in a metal casing and being fixed by soldering. The metal casing is fabricated by using a metal plate which is performed plating processing on its surface. An inserting portion of the electronic part or the like is inserted into the attachment hole such that the insetting portion is elastically supported by a contact arm. Then the insert portion is fixed to the metal casing by using a solder.

The patent document 4 (Japanese Patent Application Laid-Open No. 2000-059140) discloses a high frequency transmitting/receiving device in which an antenna board and a transmitting/receiving circuit board are provided on a front surface and back surface of a base plate, respectively, and they are connected each other by using a coaxial line which penetrates the base plate.

Since the antenna and transmitting/receiving circuit is separated by the base plate, workability of the entire assembling process is improved when the area of the transmitting/receiving circuit is small enough compared with the area of the antenna.

The patent document 5 (Japanese Patent Application Laid-Open No. HEI-02(1990)-135901) discloses a mounting structure of an electronic part for microwave circuits.

An external connection pin of the electronic part is used as an inner conductor while a metallic chassis and a conductor plating part of a through hole are used as an outer conductor so as to form a coaxial line. Thus the electronic part is connected to an external connection member through this coaxial line.

The patent document 6 (Japanese Patent Application Laid-Open No. HEI-04(1992)-069913) discloses a feed through capacitor in which a synthetic resin coated with a metallic film is used for an outer casing electrode and a penetration electrode.

Because of such structure, elastic modulus and coefficient of linear expansion of those electrodes are almost equal to that of complex dielectrics filled in the outer casing electrode, and thus not causing a gap between the complex dielectrics and the two electrodes even in a thermal stress at the time of a temperature cycle of the hot and cold. Moreover, it is disclosed that a decline of the capacitance does not occur and crack occurrence of complex dielectrics can also be prevented.

SUMMARY

An exemplary object of the invention is to provide a coaxial connector connecting structure which does not require plating treatment to a whole housing, and which does not have much occurrence of corrosion at the time of being used at outdoor.

A coaxial connector connecting structure according to an exemplary aspect of the invention includes a coaxial connector provided on an outer surface of a housing accommodating a module case of a high-frequency circuit, wherein the module case has a thick side wall with a first through-hole to provide a coaxial space forming portion as a pipe structure so as to be separated from the housing.

A high frequency circuit apparatus equipped with a coaxial connector connecting structure according to another exemplary aspect of the invention includes:

a housing provided with a first through-hole to be connected to the coaxial connector;

a module case of a high-frequency circuit accommodated in the housing and being provided with a second through-hole on a side wall adjacent to the first through-hole such that a thickness of the side wall is thicker than a side wall of the housing with the first through-hole;

a pipe member attached to the first through-hole so as to reach the second through-hole;

a module of a high-frequency circuit accommodated in the module case; and a central conductor for signals passing through the pipe and the second through-hole and being connected to a central conductor of the coaxial connector and the module electrically.

BRIEF DESCRIPTION OF THE DRAWINGS

Exemplary features and advantages of the present invention will become apparent from the following detailed description when taken with the accompanying drawings in which.

EXEMPLARY EMBODIMENT

Exemplary embodiments of the present invention will now be described in detail in accordance with the accompanying drawings.

The present invention enables to omit plating process for entire housing by separating only a member portion of forming a space of a coaxial structure (referred to as a coaxial space forming member) as a pipe structure. In the coaxial structural section of a high frequency circuit apparatus such as wireless transmitting/receiving device for a high-frequency signal (microwave signal, for example), a housing member needs to be treated with plating process in order to secure signal characteristic.

Figure 1:
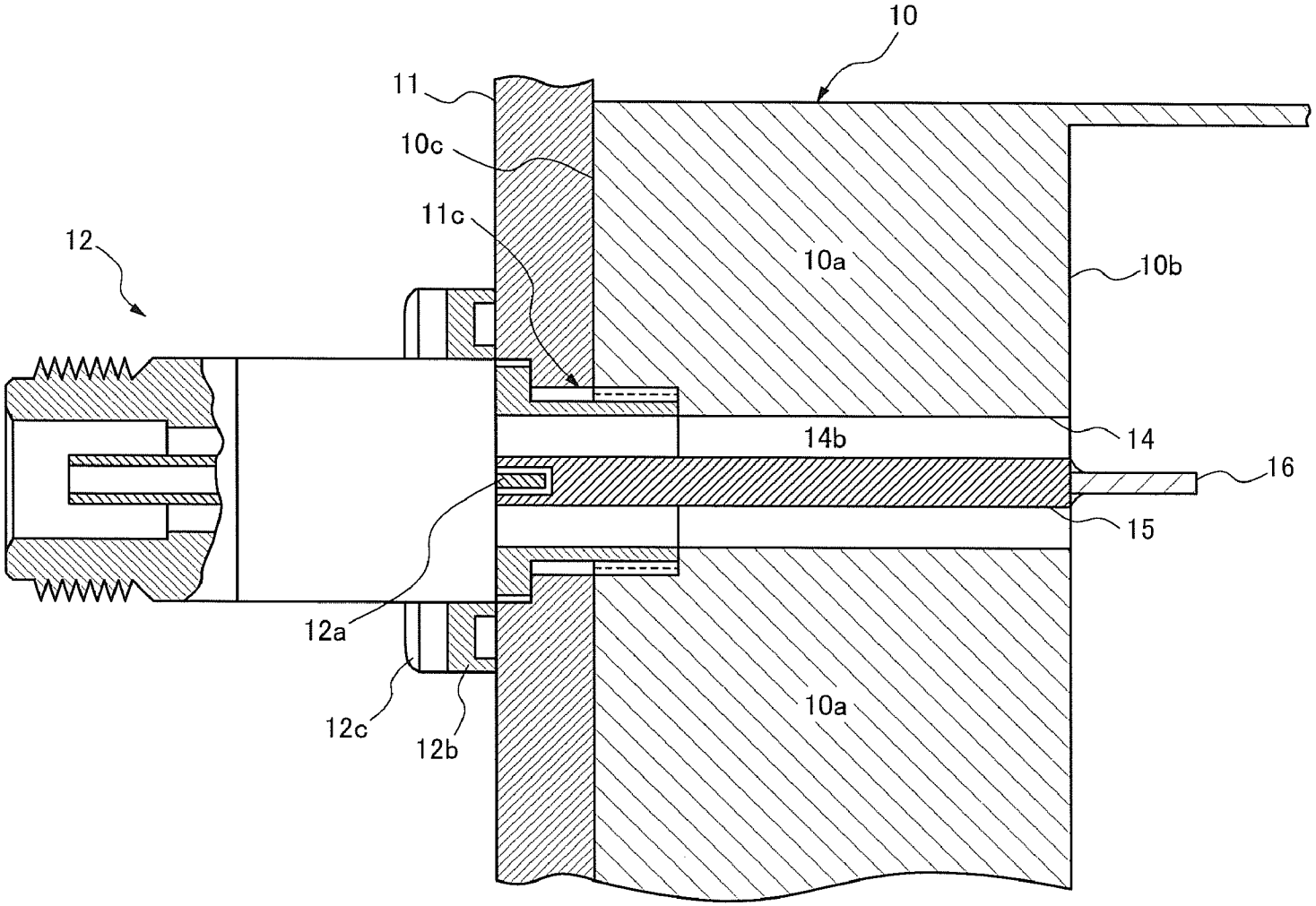
FIG. 1 is a cross sectional view showing an exemplary embodiment of a coaxial connector connecting structure according to the present invention.
Figure 2:
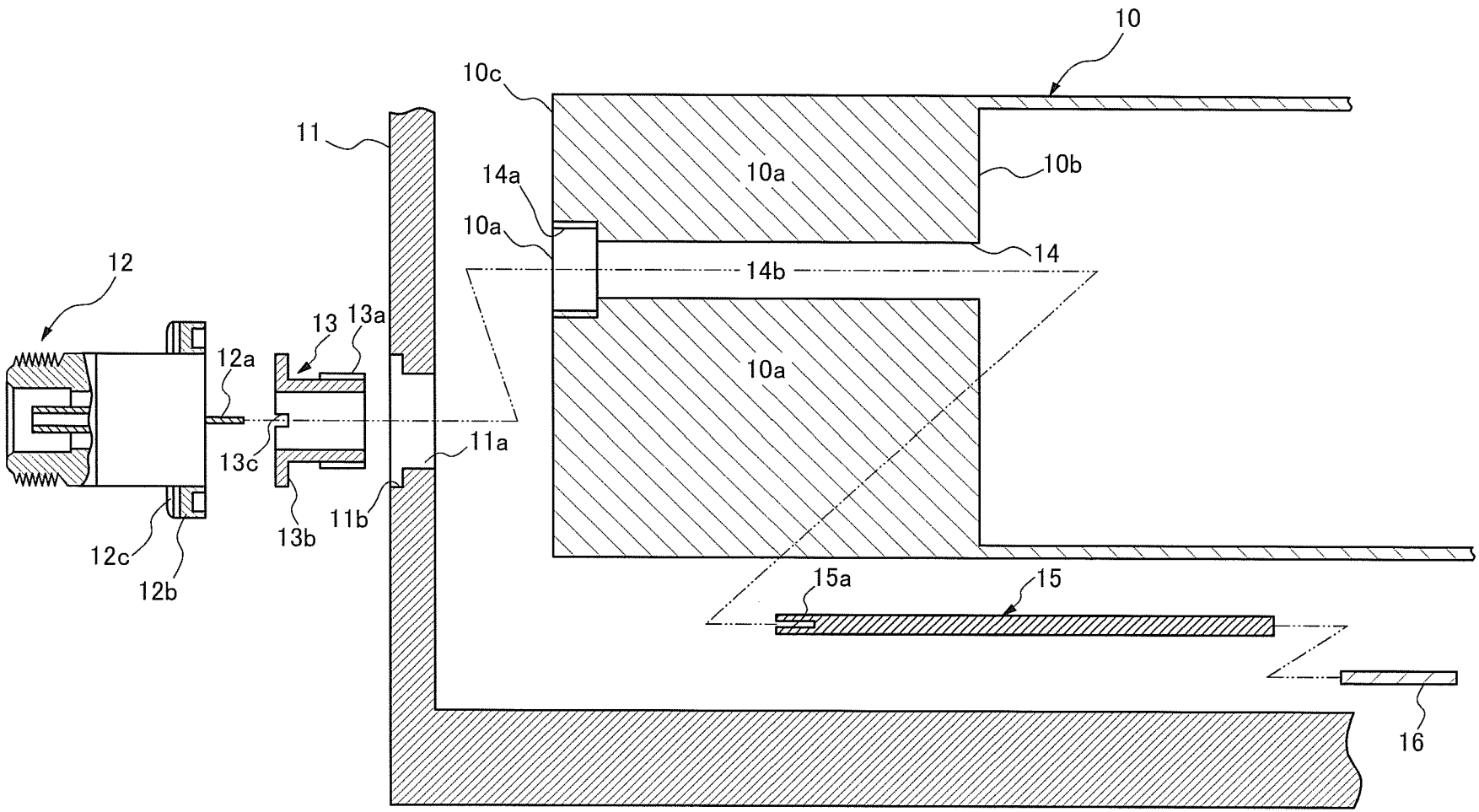
FIG. 2 is a spread fragmental cross sectional view of the coaxial connector connecting structure shown in FIG. 1.

FIG. 1 is a cross sectional view showing an exemplary embodiment of a connecting structure for a coaxial connector, i.e., a coaxial connector connecting structure according to the present invention. FIG. 2 is a spread fragmental cross sectional view of the connecting structure for the coaxial connector shown in FIG. 1.

The connecting structure includes a coaxial connector 12 which is a device interface provided on an outer side surface of a housing 11 of a high frequency circuit apparatus such as a radio receiver-transmitter, a radio transmitter, a radio receiver, a transponder and a linear amplifier. The connecting structure for the coaxial connector further includes an antenna or a coaxial cable of a high-frequency circuit module (not shown) which is installed within a module case 10 accommodated in the housing 11. The module case 10 is provided with a through-hole 14 at a side wall 10*a* adjacent to the coaxial connector 12. The side wall 10*a* of the module case 10 has a predetermined thickness (e.g., 40 mm so as to prevent infiltration of water) and thereby separating a coaxial space forming part 14*a* (see FIG. 2) as a pipe structure from the housing 11 and the module case 10. In this case, as shown in FIG. 1, the thickness of the side wall 10*a* of the module case 10 is larger than that of the side wall of the housing 11.

The housing 11 can be made of either one of such material as copper, aluminum, iron and resin.

The module case 10 can be made of either one of such material as copper and aluminum.

As an example of the coaxial connector 12, a receptor of N type connector can be used. The coaxial connector 12 is provided with a flange 12*b* so as to be fixed to the housing 11 by using fixing screws 12*c* as shown in FIG. 1.

The coaxial space forming part 14*b* is constructed with the through-hole 14 and a pipe 13 with a flange connected thereto. More specifically, the through-hole 14 is formed so as to extend between an outer wall 10*c* and an inner wall 10*b* of the side wall 10*a* of the module case 10. The pipe 13 is connected to the through-hole 14 through a through-hole 11*a* formed into the housing 11.

The through-hole 14 is provided with a threaded groove 14*a* such as a female screw on an internal circumference adjacent to the outer wall 10*c*. The pipe 13 is provided with another threaded groove 13*a* such as a male screw on an outer circumference thereof so as to be screwed together with the threaded groove 14*a*. The threaded groove 14*a* on the through-hole 14 may be a female screw while the threaded groove 13*a* may be a female screw. The housing 11 is provided with an opening 11*a* to allow the pipe 13 to pass therethrough. The opening 11*a* has a concave part lib (see FIG. 2) which accommodates a flange 13*b* at the connector side. In such structure, the housing 11 provides a flat surface to be contacted with the flange 12*b* of the coaxial connector 12. The pipe 13 is provided with a groove 13*c* as shown in FIG. 2 to allow a screwdriver's point to fasten the pipe 13 into the through-hole 14. The material of the pipe 13 can be made of either one of such material as copper and aluminum.

Silver plating (gold plating is also available) is performed respectively on both inside and outside of the module case 10, the through-hole 14 and the pipe 13. This is because to suppress a signal transmission loss owing to a skin effect in minimum. According to this exemplary embodiment, the silver plating is not performed on the housing 11 at all to save the cost of plating process.

One end (in FIG. 1, the left end) of a central conductor 15 for signals is connected to a pin 12*a* of the coaxial connector 12 facing toward the module case 10 within the pipe 13. The other end of the central conductor 15 is connected to an antenna 16 having a length of ⅛-1/10 of the length of the central conductor 15 so as to be connected to an antenna or a coaxial cable (not shown) of a module (an electronic circuit) in the module case.

The outside diameter of the central conductor 15 and the inside diameter of the through-hole 14 are set to have the value that can correspond to impedance (50Ω or 75Ω, for example) of a coaxial cable connected to the coaxial connector 12. This is because the reflection loss is made to be minimal.

Figure 3:
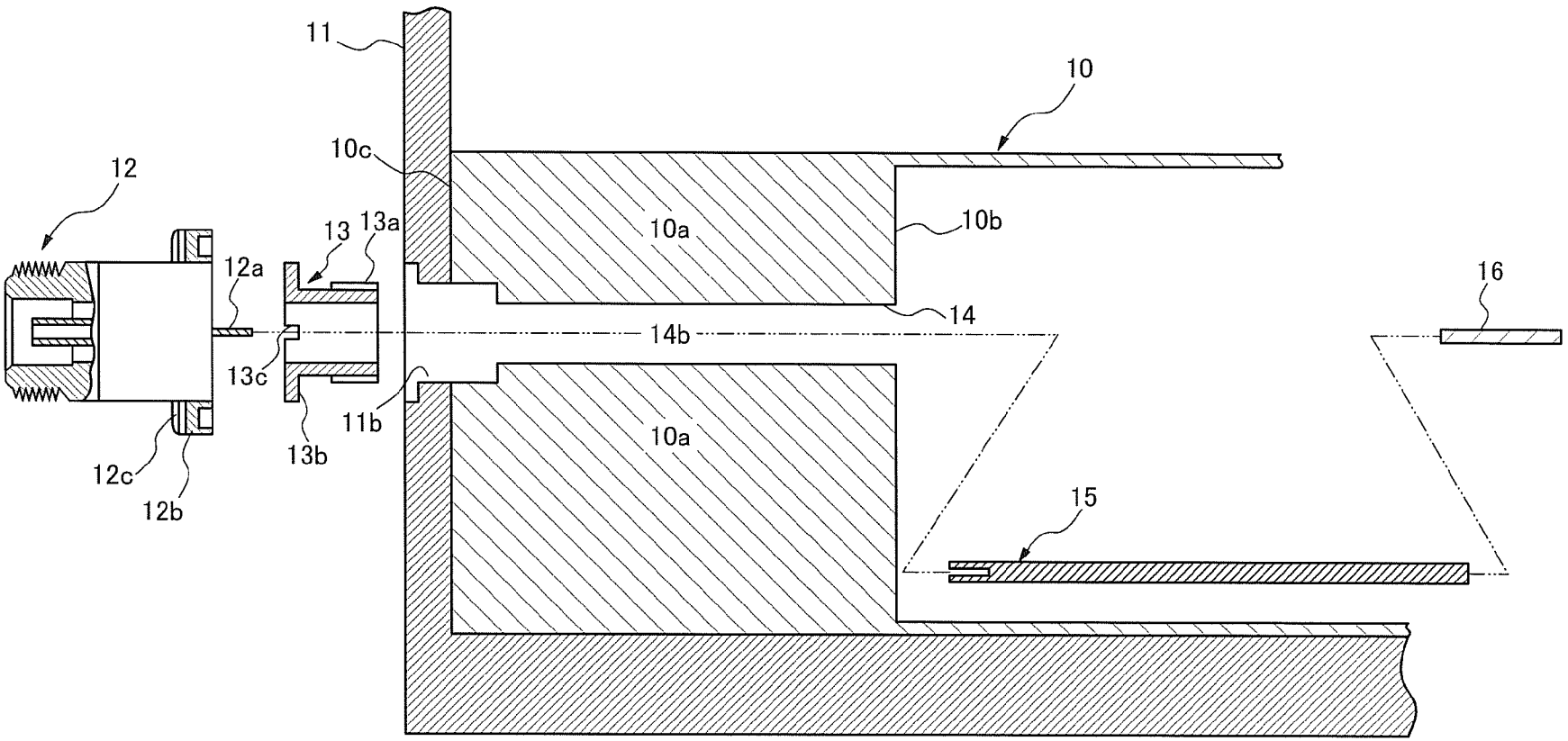
FIG. 3 is a cross sectional view showing a state that a module case 10 is accommodated in the housing 11 shown in FIG. 2.
Figure 4:
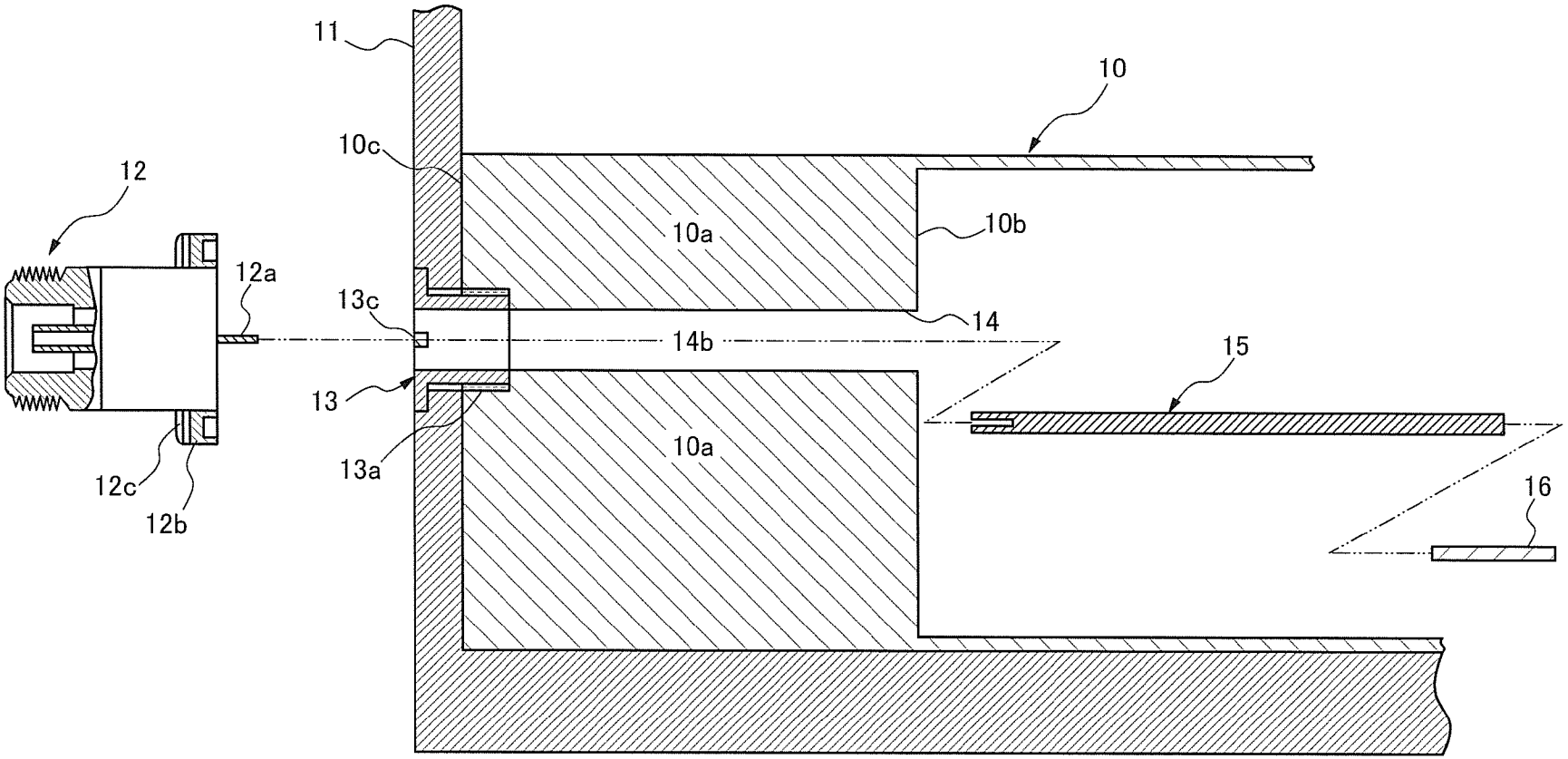
FIG. 4 is a cross sectional view showing a state that a pipe is connected to a through-hole shown in FIG. 3.
Figure 5:
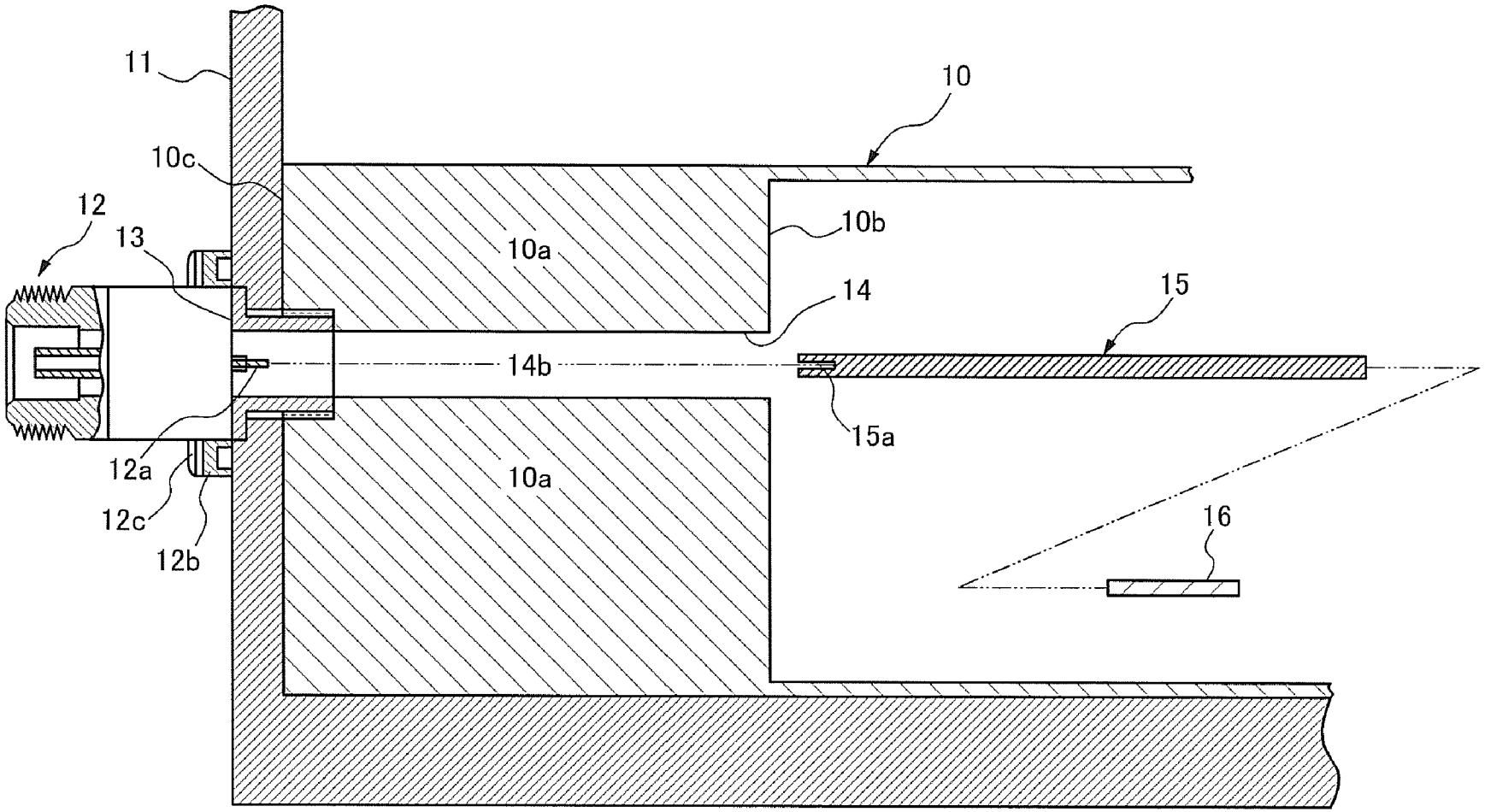
FIG. 5 is a cross sectional view showing a state that a coaxial connector 12 shown in FIG. 4 is fixed on the housing 11.
Figure 6:
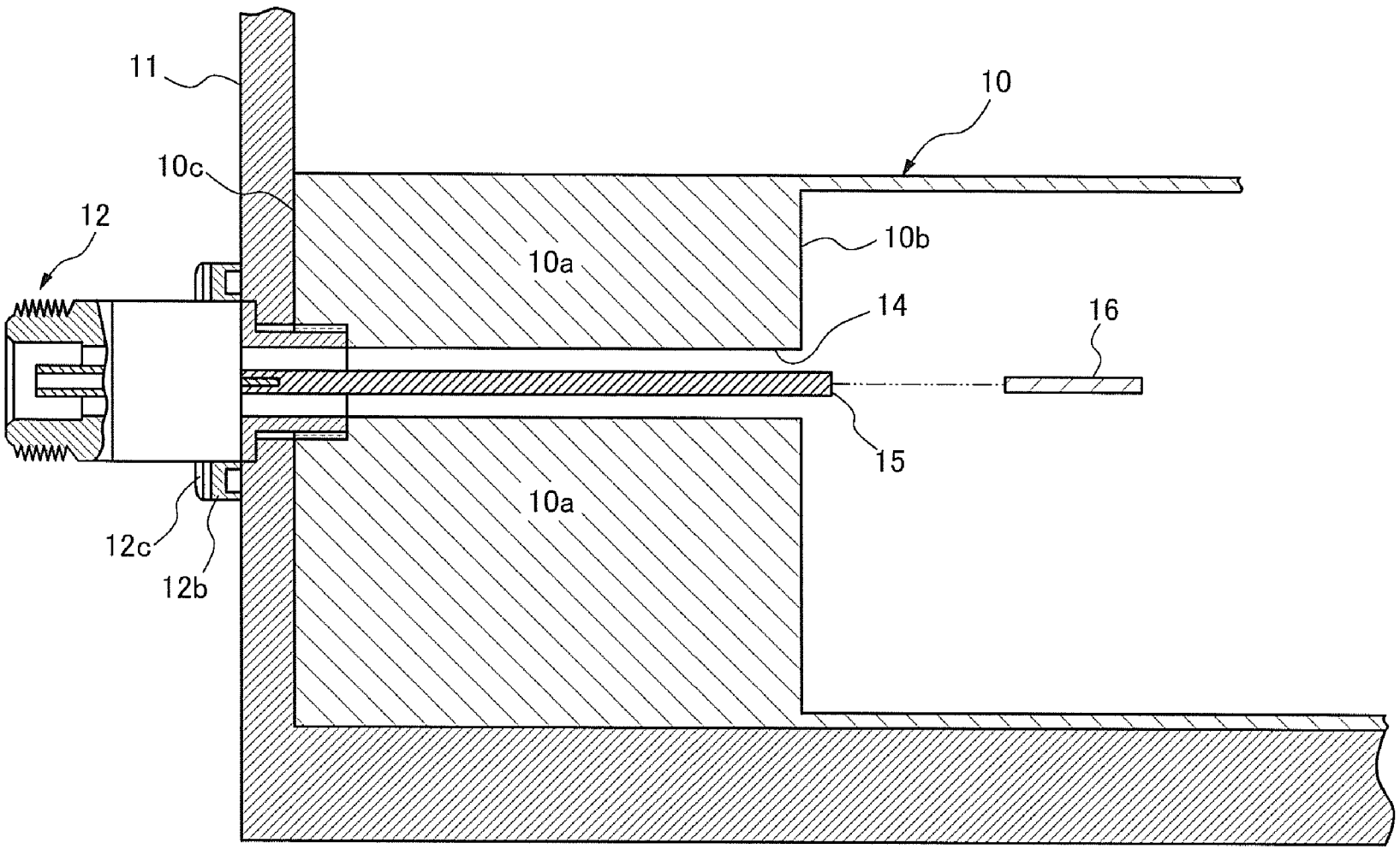
FIG. 6 is a cross sectional view showing a state that a central conductor 15 for signals shown in FIG. 5 is connected to the coaxial connector 12.

FIG. 3 is a cross sectional view showing the state that the module case 10 is accommodated in the housing 11 shown in FIG. 2. FIG. 4 is a cross sectional view showing the state that the pipe 13 is connected to a through-hole 14 shown in FIG. 3. FIG. 5 is a cross sectional view showing the state that a coaxial connector 12 shown in FIG. 4 is fixed to the housing 11. FIG. 6 is a cross sectional view showing the state that the central conductor 15 for signals shown in FIG. 5 is connected to the coaxial connector 12.

Assembly of a high-frequency circuit having the coaxial connector connecting structure will be described.

As shown in FIG. 3, the module case 10 is accommodated in the housing 11, and it is adjusted so that an opening 11*a* of the housing 11 and the opening of the through-hole 14 of the module case 10 face each other.

The pipe 13 is inserted in the opening 11*a* of the housing 11 from outside of the housing 11 as shown in FIG. 4, and being fasten by using a screwdriver (not shown) so that the male screw 13*a* and the female screw 14*a* are screwed together. As a result, the flange 13*b* of the pipe 13 is accommodated in the concave part lib of the housing 11 so as to provide a flat side surface for the housing 11.

The coaxial connector 12 is fixed to the housing 11 by using the screw 12*c* so that the pin 12*a* is inserted in the opening of the pipe 13 which is inserted in the opening 11*a* of the housing 11 as shown in FIG. 5.

As shown in FIG. 6, a small hole 15*a* provided at one tip end of the central conductor 15 for signals is coupled or soldered to the pin 12*a* of the coaxial connector 12. The other end is connected or soldered to the antenna 16 and thereby fabricating the coaxial connector structure shown in FIG. 1.

Figure 7:
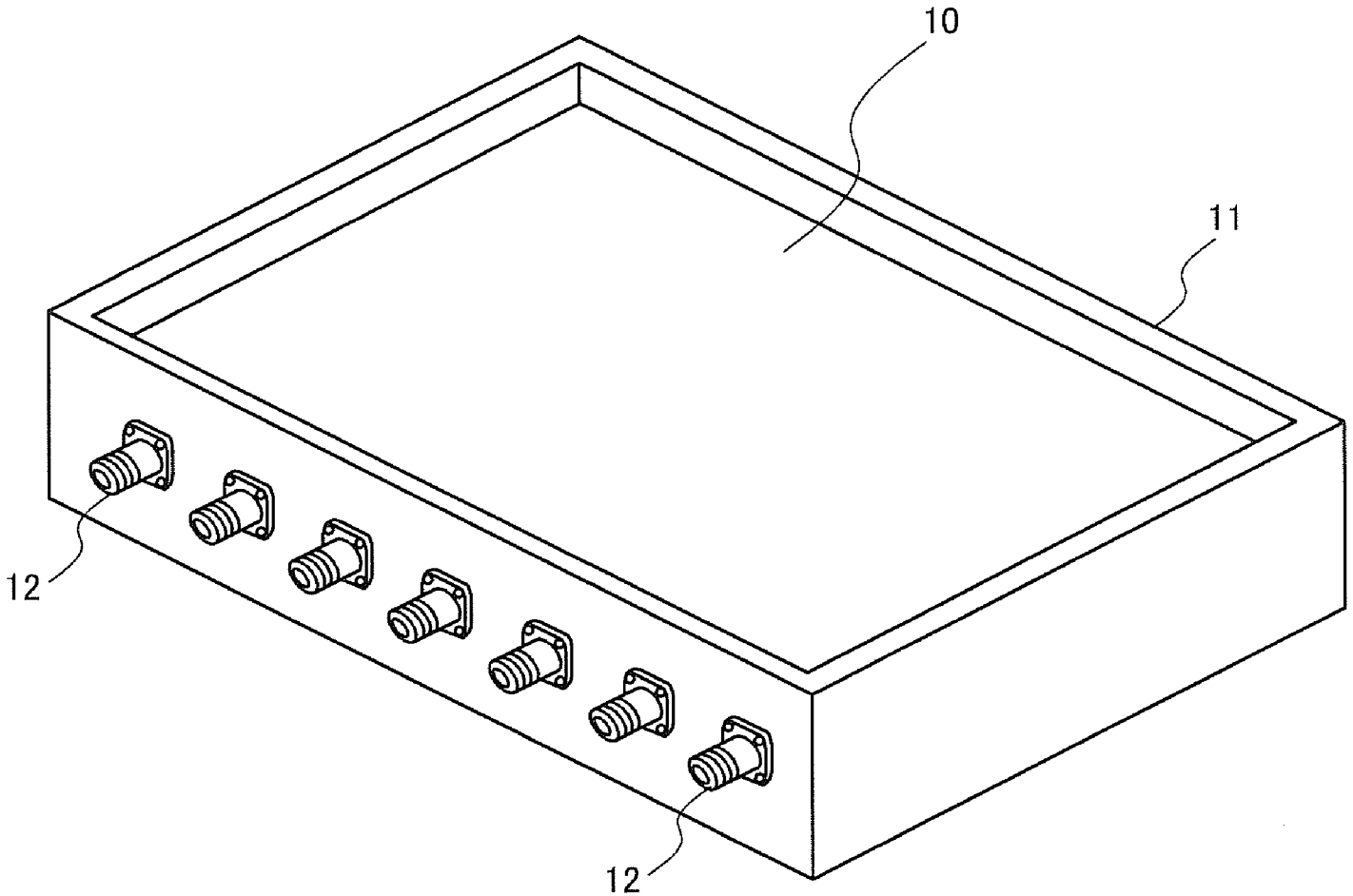
FIG. 7 is a housing of a high-frequency circuit, a module and an outward appearance perspective view showing a positional relationship of the coaxial connector.

FIG. 7 is a perspective view showing the positional relationship of the housing of the high-frequency circuit, the module and the coaxial connector.

As shown in FIG. 7, a plurality of the coaxial connectors 12 are attached on the housing 11 which accommodated the module case 10. Although the numbers of the coaxial connectors are seven in the drawing, attached numbers of the coaxial connectors are not limited to the case shown in FIG. 7.

As is described above, a surrounding area of the central conductor 15 for signals is provided with the space 14*b* separated from the housing 11. The space 14*b* is formed with the through-hole 14 and the pipe 13 both plated with silver inside thereof so as to secure the signal characteristic. Since the pipe 13 and the module case 10 for the radio transmission and reception circuits need to be the same electric potential for a signal characteristic, threads of the male/female structure are formed on respective members and mechanically connected each other, e.g., the externally threaded pipe 13 and the internally threaded through-hole 14 are screwed together, and successive silver plating areas are formed so as to secure the same electric potential.

As shown in FIG. 7, the coaxial connector 12 and the module case 10 are provided on the outside and inside of the housing 11, respectively.

The plated separated coaxial structures shown in FIGS. 1-7, there is no mechanical operation in its implementation state.

The embodiment mentioned above indicates an example of the preferred embodiment of the present invention and without limiting to the subject thereof, and the present invention may have various transformable implementations in the range that does not deviate from the point of the invention.

(1) In this exemplary embodiment, although the coaxial space forming part has been described by the cylinder (pipe) style shape, the present invention is not limited to this, and it may be a square tube.

(2) In this exemplary embodiment, although the cross-sectional shape of the central conductor for signals is a circle shape, the present invention is not limited to this, and it may be a square shape. It may be the shape with the circle projection of a plurality of diameter differences on a bar having a round cross-section.

(3) In this exemplary embodiment, although the plated separated coaxial structure is only one portion, the present invention is not limited to this, and they may be a plurality of numbers.

(4) In this exemplary embodiment, although the space forming materials is made of metal, the present invention is not limited to metal, but it may be the material excellent in other signal characteristic such as conductive resin.

Figure 8:
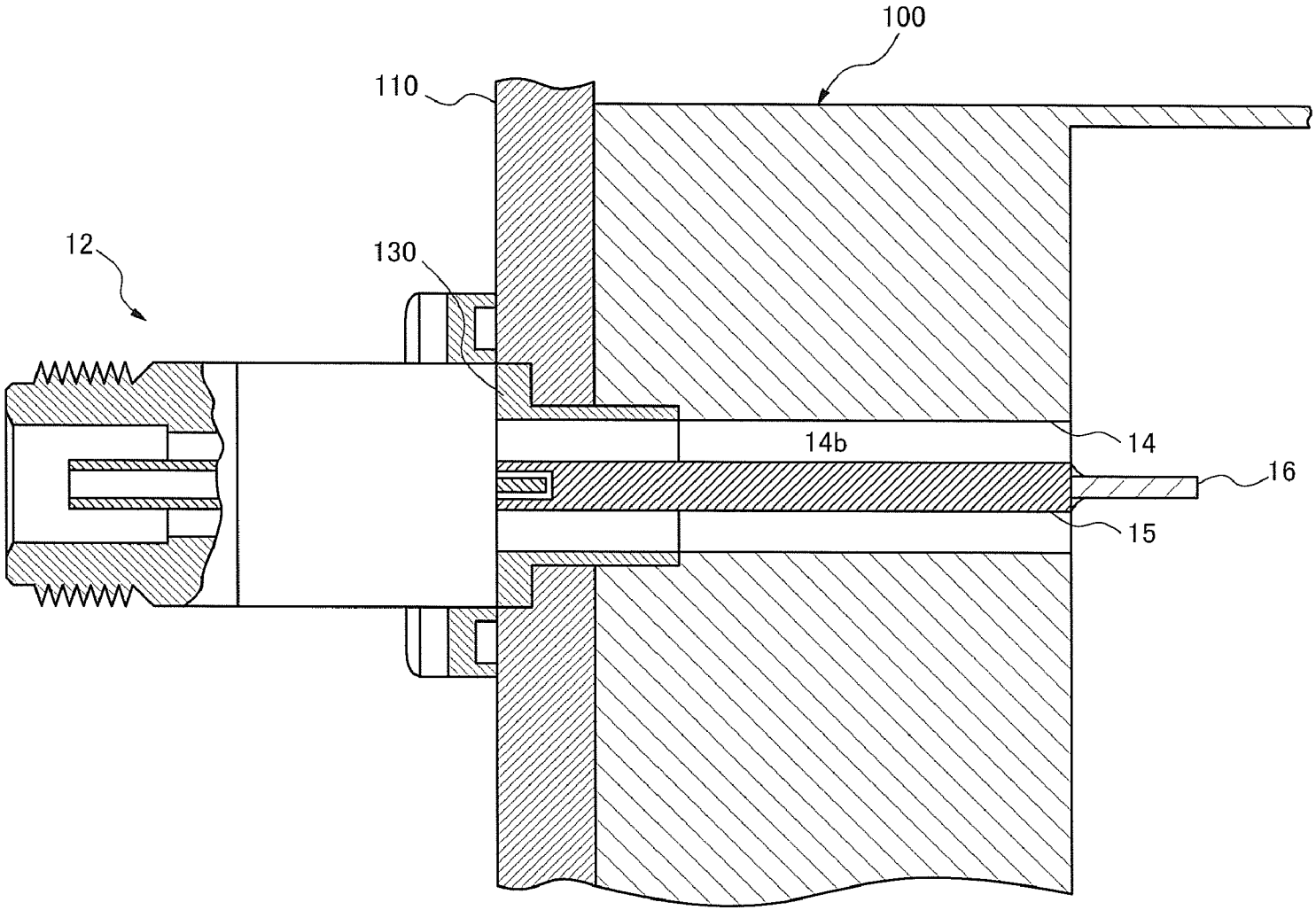
FIG. 8 is a cross sectional view showing another exemplary embodiment of the coaxial connector connecting structure according to the present invention.

(5) In this exemplary embodiment, although the pipe and the module case for radio transmission and reception circuits have described in case of implementation by a connection by a tap of male and female, the present invention is not limited to this, and they may be pressed-in structure as shown in FIG. 8.

In FIG. 8, a pipe 130 has an outer diameter which is slightly larger than the pipe 13 shown in FIG. 1 so as to be fixed with both holes of a housing 110 and a module case 100, respectively. Although the pipe 130 and module case 100 are not provided with threaded grooves thereon, the pipe 130, the housing 110 and the module case 100 are all fixed together by pressed-in mechanism. Alternatively, such fixed structure may be replaced by using screw members.

In the telecommunications sector on the manufacturing industry, the present invention can be used as mounted structural section of a high frequency circuit apparatus such as a communication apparatus, i.e., a wireless transmitter and receiver.

The related art described in the background art causes a problem, such as corrosion, because when using it outdoors, water such as rainwater tends to adhere, and when water adheres, there is a fear that the corrosion becomes easy to occur. In addition, the whole housing needs to be plated because the connector and the conductor are connected directly.

According to the exemplary embodiment of the present invention, a coaxial connector connecting structure without needing whole plating of the housing and little occurrence of corrosion when it is used in outdoor can be realized by forming the side wall of the module case on the coaxial connector side into the predetermined thickness and forming the through-hole at the side wall in the position of the coaxial connector, because the coaxial space forming part is separated as a pipe structure.

An exemplary advantage according to the invention is that the cost for plating process is decreased because of that the necessity of plating the entire surface of the housing is not needed by separating only the coaxial space forming part which must be plated as a pipe structure. When the device is used as an outdoor equipment, although water such as rainwater adheres to an electric potential difference part between the plating material of the housing part and the coaxial connector and generates corrosion in the related arts, the present invention realizes the structure that enables to connect the central conductor at a place where water does not adhere by separating the pipe from the housing.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

Further, it is the inventor's intention to retain all equivalents of the claimed invention even if the claims are amended during prosecution.

What is claimed is:

1. A coaxial connector connecting structure comprising:

a module case having a first side wall with a first through-hole to provide a coaxial space portion;

a housing accommodating said module case, said housing having a second side wall with a second through-hole;

a coaxial connector fixed to an outer surface of said housing adjacent to said second through-hole; and a pipe member provided within said second through-hole so as to be extended between said coaxial connector and said module case, wherein a thickness of said first side wall is larger than a thickness of said second side wall, and wherein said pipe member extends into said first through-hole such that a greater portion of said first through-hole does not have said pipe member extended thereinto.

2. The coaxial connector connecting structure according to claim 1, wherein said coaxial connector side of said pipe member is provided with a flange, and a concave part which accommodates said flange is formed on said coaxial connector side of said housing.

3. The coaxial connector connecting structure according to claim 1, wherein said second through-hole is internally threaded while said pipe member is externally threaded so as to be screwed each other.

4. The coaxial connector connecting structure according to claim 1, wherein said pipe member, said housing and said module case are fixed by a screwing means.

5. The coaxial connector connecting structure according to claim 1, wherein said pipe member, said housing and said module case are fixed by a press-in means.

6. The coaxial connector connecting structure according to claim 1, wherein inside surfaces and outside surfaces of said module case and said pipe member are plated with gold or silver, respectively.

7. The coaxial connector connecting structure according to claim 1, wherein one end of said conductor for signals is connected to a pin of said coaxial connector so as to pass a center of said through-hole, and the other edge of said conductor is connected to an antenna or a coaxial cable.

8. The coaxial connector connecting structure according to claim 1, wherein said coaxial space forming portion permits a conductor to be inserted therethrough such that no part of the coaxial connector connecting structure separates the conductor from the interior surface of the first through-hole upon insertion of the conductor into said first through-hole, through a majority of the first through-hole.

9. The coaxial connector connecting structure according to claim 1, wherein said first through-hole is plated on an interior surface thereof, said pipe member is also plated on an interior surface thereof, and said pipe member extends into said first through-hole such that a greater portion of said first through-hole does not have said pipe member extended thereinto, and wherein said coaxial space forming portion comprises said first through-hole as plated on the interior surface thereof, and permits a conductor to be inserted therethrough such that no part of the coaxial connector connecting structure separates said conductor from plating on the interior surface of said first through-hole upon insertion of said conductor into said first through-hole, through a majority of said first through-hole.

10. A high frequency device equipped with a coaxial connector comprising:

a housing provided with a second through-hole on a second side wall to be connected to said coaxial connector;

a module case of a high-frequency circuit accommodated within said housing and being provided with a first through-hole on a first side wall adjacent to said second through-hole;

a pipe member attached to said first through-hole so as to reach said second through-hole;

a central conductor for signals passing through said pipe member and said second through-hole and being connected to a central conductor of said coaxial connector and said module electrically, wherein a thickness of said first side wall is larger than that of said second side wall, wherein said first through-hole is plated on an interior surface thereof, said pipe member is also plated on an interior surface thereof, and said pipe member extends into said first through-hole such that a greater portion of the first through-hole does not have the pipe member extended thereinto, and wherein said coaxial space forming portion comprises said first through-hole as plated on the interior surface thereof, and permits said central conductor to be inserted therethrough such that no part of the coaxial connector connecting structure separates said central conductor from plating on the interior surface of said first through-hole upon insertion of said central conductor into the first through-hole, through a majority of said first through-hole.

* * * * *